US012011671B2

(12) United States Patent
Kiani

(10) Patent No.: US 12,011,671 B2
(45) Date of Patent: Jun. 18, 2024

(54) AMUSEMENT RIDE

(71) Applicant: Ali Kiani, Coquitlam (CA)

(72) Inventor: Ali Kiani, Coquitlam (CA)

(73) Assignee: Ali Kiani (CA)

( * ) Notice: Subject to any disclaimer, the term of this patent is extended or adjusted under 35 U.S.C. 154(b) by 0 days.

(21) Appl. No.: 17/485,526

(22) Filed: Sep. 27, 2021

(65) Prior Publication Data

US 2023/0102806 A1 Mar. 30, 2023

(51) Int. Cl.
*A63G 27/02* (2006.01)
*A63G 9/16* (2006.01)

(52) U.S. Cl.
CPC ..... *A63G 27/02* (2013.01)

(58) Field of Classification Search
CPC . A63G 1/00; A63G 1/28; A63G 27/00; A63G 27/02; A63G 9/16
USPC ..... 472/44–47, 119
See application file for complete search history.

(56) References Cited

U.S. PATENT DOCUMENTS

| | | | | | |
|---|---|---|---|---|---|
| 3,072,399 | A * | 1/1963 | Simpkins | A63G 27/00 | 472/30 |
| 4,410,173 | A * | 10/1983 | Bohme | A63G 9/16 | 472/44 |
| 2004/0192453 | A1* | 9/2004 | Esparza | A63G 9/16 | 472/44 |
| 2004/0198523 | A1* | 10/2004 | Kroon | A63G 27/00 | 473/32 |
| 2006/0035715 | A1* | 2/2006 | Threlkel | A63G 27/04 | 472/47 |
| 2020/0108323 | A1* | 4/2020 | Groels | A63G 1/06 | |
| 2020/0230507 | A1* | 7/2020 | Lee | A63G 9/08 | |
| 2020/0324212 | A1* | 10/2020 | Sornik | A63G 27/00 | |

* cited by examiner

*Primary Examiner* — Kien T Nguyen

(57) ABSTRACT

An amusement ride allows at least one rider to rotate/swing around a distal pivot axis, wherein said distal pivot axis is rotatable around rotary axis projecting away from said distal pivot axis, wherein the rotary axis is in parallel direction with said distal pivot axis, wherein the rotary axis is distal from a swing axis and rotates/swings around said swing axis, wherein swing axis is supported by a frame, wherein the frame adapted to be mounted on a supporting surface.

9 Claims, 11 Drawing Sheets

AMUSEMENT RIDE

1. FIELD OF THE INVENTION

The invention relates to the field of amusement rides. More particularly, the invention to be used to add at least one rotary unit, including a passenger seat, to a swinging arm that swings/rotates around a swing axis, wherein the swing axis is distal from said rotary unit and supported by a frame.

2. BACKGROUND

Amusement rides have long been some of the well liked riders in amusement parks. Rider load and unload at a platform, typically at the low elevation. At the beginning of each ride cycle, a Amusement ride vehicle is locked to be safe to upload riders. Vehicle is then released to gain kinetic energy from potential energy, if it is at the highest point of the track, or from electrical motor installed on the vehicle or track. The Amusement ride track typically includes various loops, turns, inversions and other configuration intended to thrill the rider. A number of amusement rides have been devised in which riders can apparently race each other in a simulated dragster format.

Traditional Amusement rides travel along rail tracks and provide their riders with stationary seat which fix the motion of the riders to the direction of the travel of vehicle.

The overall effect attained by traditional Amusement rides is to statically couple riders to the vehicle and therefore sense essentially the same motions in forces experienced by the vehicles in which they ride. This problem is experienced by most amusement rides, which due to static nature of the ride provides the same ride sensation and experience every time it is ridden.

Nowadays amusement rides have evolved from simple equipment to advanced and technically sophisticated equipment with special mechanisms and various movements. Thanks to virtual reality and by using new technology, new designs and software, riders experience more joy and excitement of amusement rides.

DESCRIPTION

Described amusement ride enabling at least one rider to rotate/swing around a distal pivot axis, wherein said distal pivot axis is rotatable around rotary axis projecting away from said distal pivot axis, wherein the rotary axis is in parallel direction with said distal pivot axis, wherein the rotary axis is distal from a swing axis and rotates/swings around said swing axis, wherein swing axis is supported by a frame, wherein the frame adapted to be mounted on a supporting surface.

SUMMARY OF THE INVENTION

Therefore, the object of the present invention comprises at least one seat mounted on a chassis, wherein that seat and chassis pivotally connected to a rotary arm and rotates/swings around a pivot axis, wherein the pivot axis are distal from the center mass of the seat and the chassis together, wherein the rotary arm rotatably connected to a swing arm and rotates around a rotation axis, wherein the rotation axis is in parallel direction with pivot axis, and is distal from pivot axis, wherein the swing arm swinging/rotating around a swing axis, wherein swinging axis is distal from rotation axis, comprising:

A frame including at least one base support adapted to be mounted on a supporting surface, and a supporting location wherein said supporting location is distal from base support vertically;

At least one swing arm rotatably/pivotally connected to the supporting location of said frame and rotates/swings around a swing axis;

At least one rotary arm rotatably connected to the swing arm and rotates around a rotation axis wherein said rotation axis is distal from swing axis, At least one seat assembly comprising a chassis rotatably/pivotally connected to the rotary arm and rotates/swings around a pivot axis, wherein the pivot axis is distal from the rotation axis, wherein pivot axis is approximately parallel with the rotation axis, at least one seat mounted on the chassis for seating a passenger, wherein the seat assembly and the passenger together having a center mass that is distal from the pivot axis;

At least one drive means mounted between said at least one swing arm and said at least one rotary arm rotating rotary arm around the rotation axis.

At least one swing drive means mounted between said support frame and said at least one swinging/rotating said at least one swing arm around the swing axis;

Said at least one swing drive means comprising at least one actuator or motor gearbox providing required torque for rotating said at least.

Said at least one drive means comprising at least one actuator or motor gearbox providing required torque for rotating said at least one rotary arm. Said at least one drive means is programmed to be used optional and enabling motor gearbox to be activated and move or stops to maintain a specific orientation for the rotary arm.

Said at least one seat comprising a restraint for restraining said at least one rider through motions in all three planes;

The described amusement ride allows said at least one rider to rotate/swing around said pivot axis to maintain an orientation due to the weight and the forces as said at least one rotary arm rotates, and said at least one swing arm swinging/rotating around said swing axis.

Furthermore, another aspect of the invention is an amusement ride comprising:

A support frame including at least one base support adapted to be mounted on a supporting surface, and a supporting location wherein said supporting location is distal from base support vertically;

At least one rotary-swing arm having a swing crank-arm and a rotary head-arm; a first end of the swing crank-arm rotatably/pivotally connected to the supporting location of said frame and rotates/swings around a swing axis; a first end of the rotary head-arm rotatably connected to a second end of the swing crank-arm rotating/swinging around a head axis.

At least one swing drive means mounted between said support frame and said at least one swing crank-arm swinging/rotating said swing crank-arm of the rotary-swing arm around the swing axis;

At least one head drive means mounted between said swing crank-arm and said rotary head-arm for rotating said rotary head-arm around said head axis;

At least one rotary arm rotatably connected to a second end of the rotary head-arm and rotates around a first axis, wherein said first axis is distal from the swing axis;

At least on seat assembly comprising a chassis rotatably/pivotally connected to said at least rotary arm and rotates/swings around a second axis, wherein the second axis is distal from the first axis, wherein second axis is approximately parallel with the first axis, at least one seat mounted on the chassis for seating a passenger, wherein the seat assembly and the passenger together having a center mass that is distal from the second axis;

At least one rotary drive means mounted between said rotary head-arm and said at least one rotary arm rotating said at least one rotary arm around the first axis.

Said at least one swing drive means comprising at least one actuator or motor gearbox providing required torque for rotating said at least one rotary-swing arm around the swing axis.

Said at least one head drive means comprising at least one actuator or motor gearbox providing required torque for rotating said rotary head-arm around the head axis. Said at least one head drive means is programmed to be used optional and enabling the motor gearbox to be activated and move or stops to maintain a specific orientation for the rotary head-arm.

Said at least one drive means comprising at least one actuator or motor gearbox providing required torque for rotating said at least one rotary arm around the first axis. Said at least one drive means is programmed to be used optional and enabling motor gearbox to be activated and move or stops to maintain a specific orientation for the rotary arm.

Said at least one seat comprising a restraint for restraining said at least one rider through motions in all three planes.

The described aspect of the invention is an amusement rides that allows said at least one rider to rotate/swing around said second axis substantially due to the weight and the forces as said at least one rotary arm rotates, said at least one swing arm swinging/rotating around said swing axis, and rotary head-arm rotating around the head axis.

BRIEF DESCRIPTION OF DRAWINGS

Other features and advantages of described invention will become apparent in the following detailed description of preferred embodiments with reference to the appended drawings, of which.

DETAILED DESCRIPTION OF EMBODIMENT

The description which follows and the embodiments described therein are provided by way of illustration of an example of particular embodiment of principles of present invention. This example is provided for the purposes of explanation and not limitation of those principles and of the invention.

Figure 7:
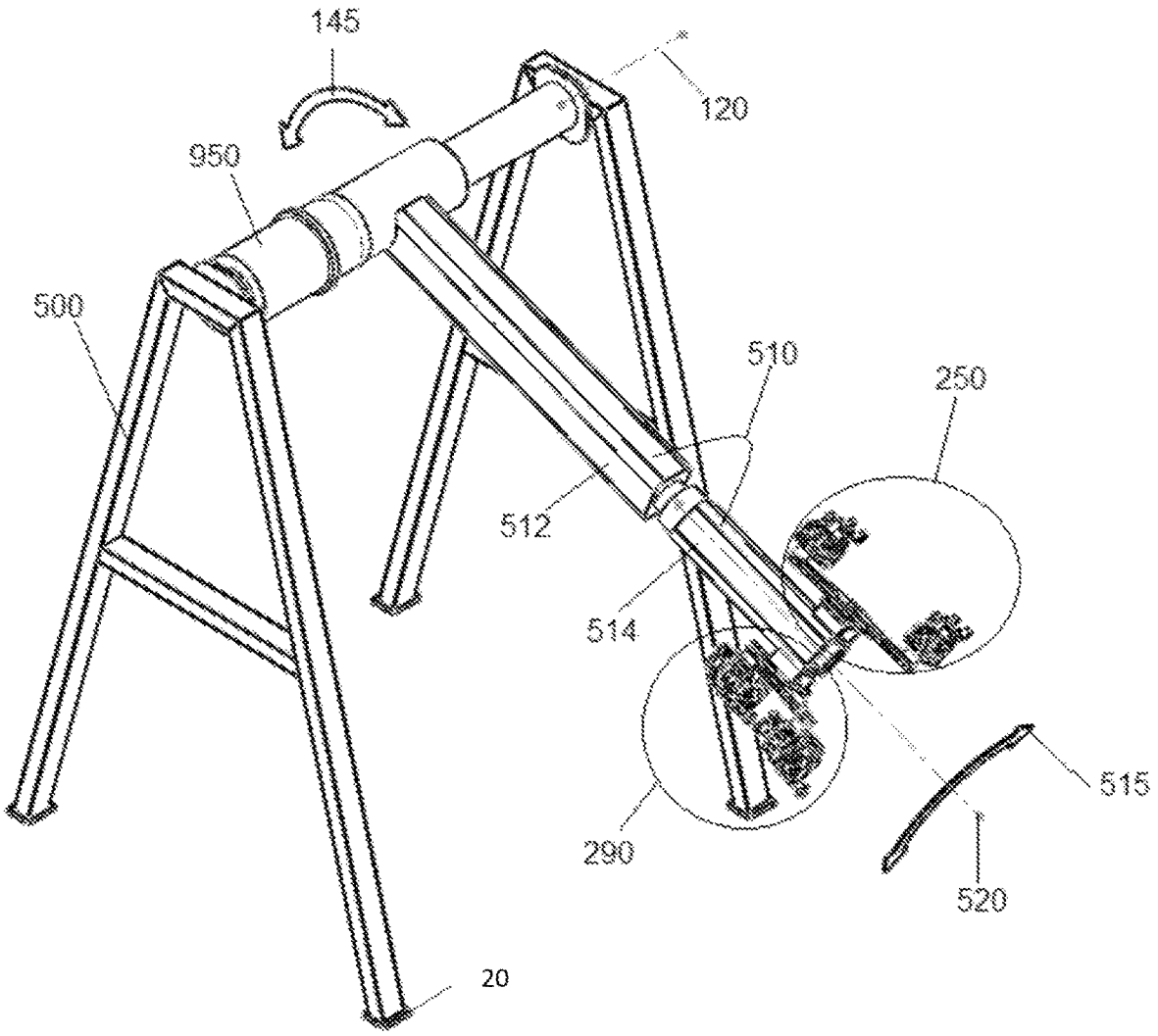
FIG. 7 is a perspective view of another embodiment of the described amusement ride and shows frame, rotary-swing arm, swing drive means, rotary unites, and the direction of the axial rotation 515 of the rotary crank-arm.
Figure 8A:
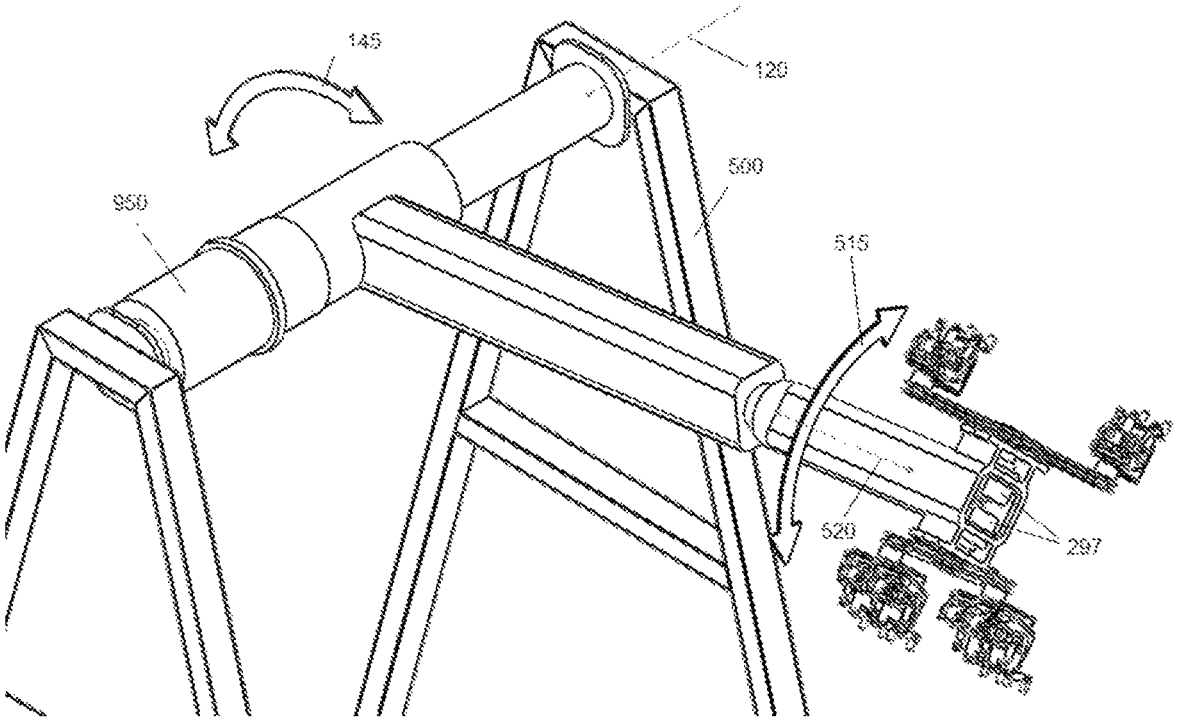
FIG. 8A is a perspective view of another embodiment of the described amusement ride and shows more details of the rotary units and the drive means.
Figure 8B:
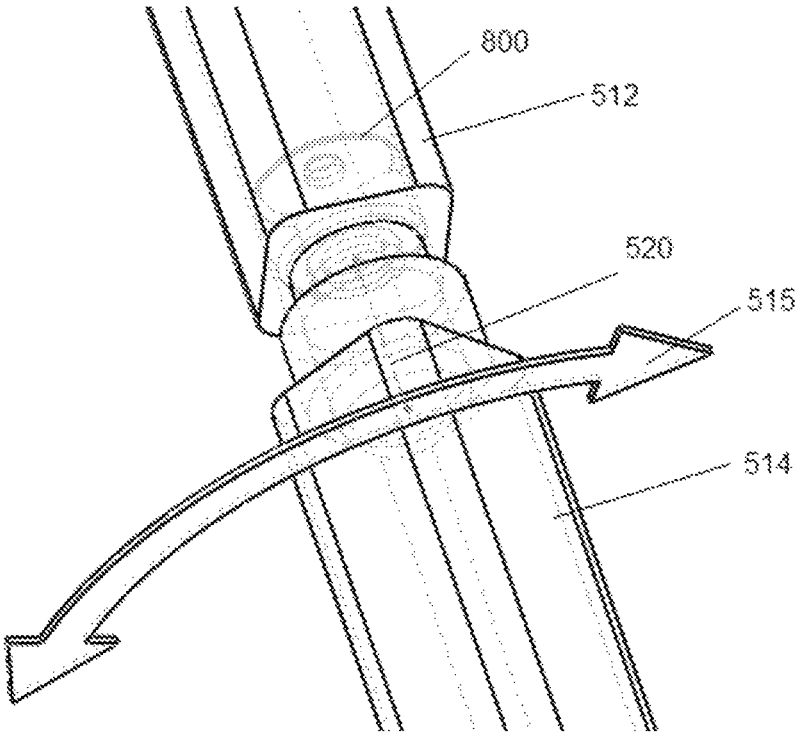
FIG. 8B is a perspective view of another embodiment of the described amusement ride and shows the axial drive means and how the rotary head-arm rotates axially in relation to the swing crank-arm.

The FIGS. 1 to 6 shows the preferred embodiment of an amusement ride, and the FIGS. 7 and 8 show another embodiment of the described amusement ride.

The present invention is shown to comprise:

The frame, swing arm, rotary unites, swing drive means, and rotary unites.

Figure 1:
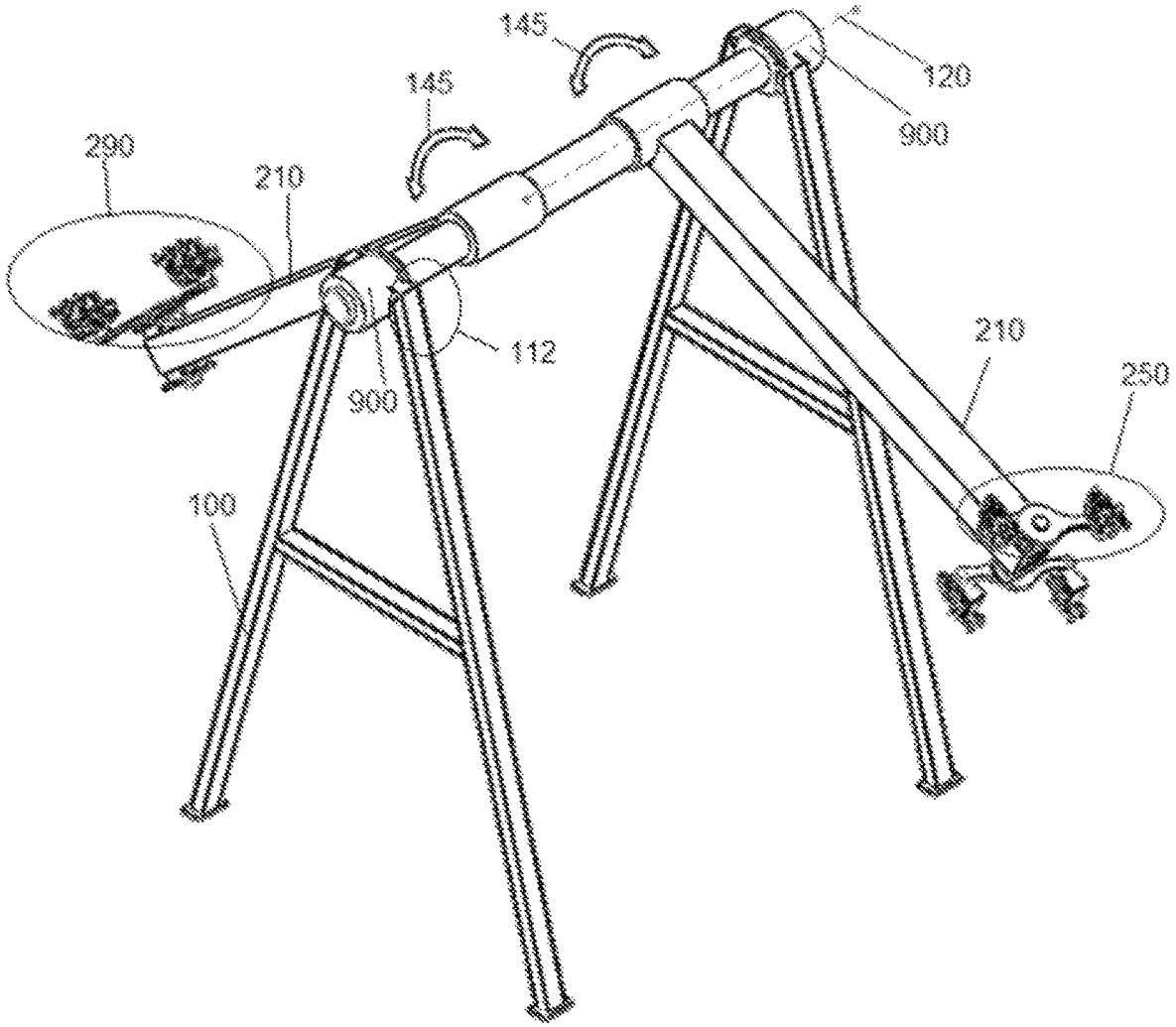
FIG. 1 is a perspective view of described amusement ride, and shows the frame, swing arm, rotary unit and how the amusement rides working.
Figure 2:
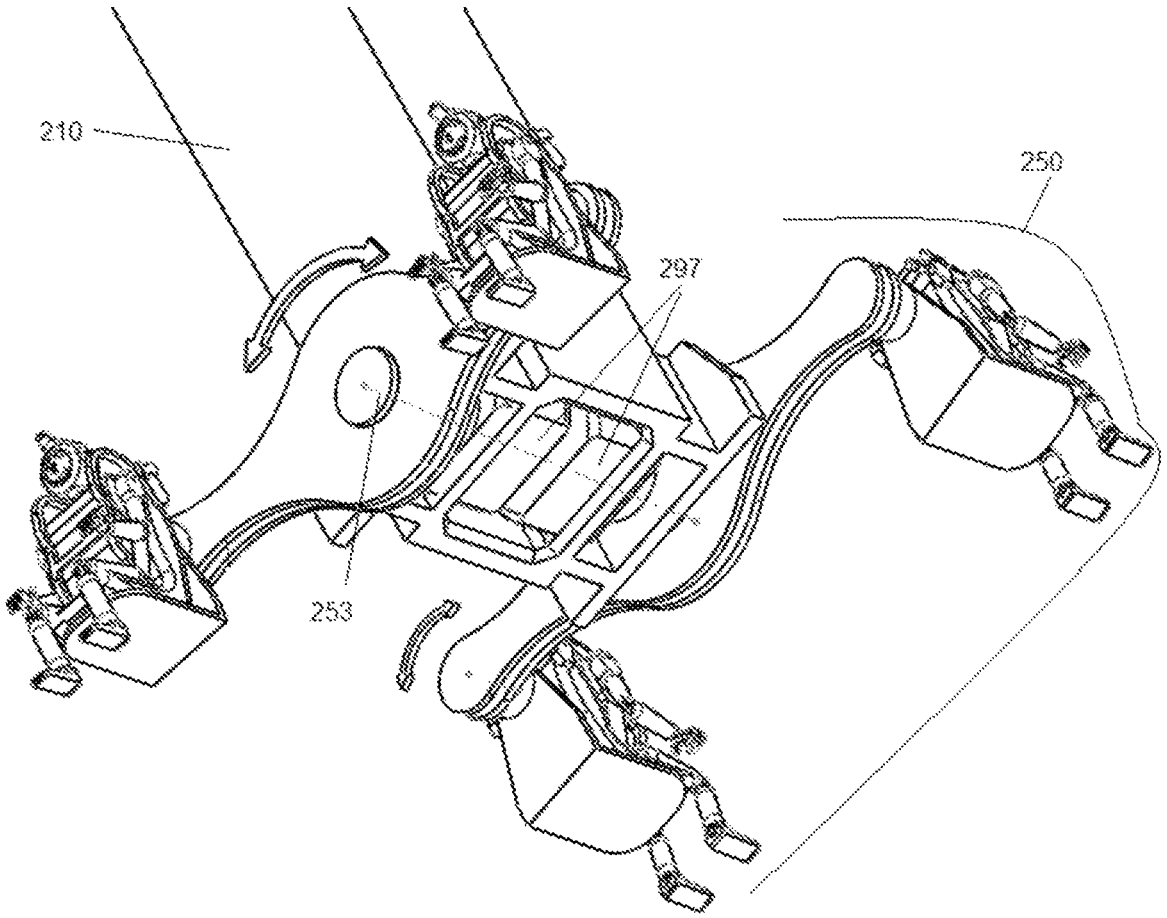
FIG. 2 is a perspective view of described amusement ride, and shows the rotary unit including rotary arm, drive means, seat assembly, and swing arm.
Figure 3:
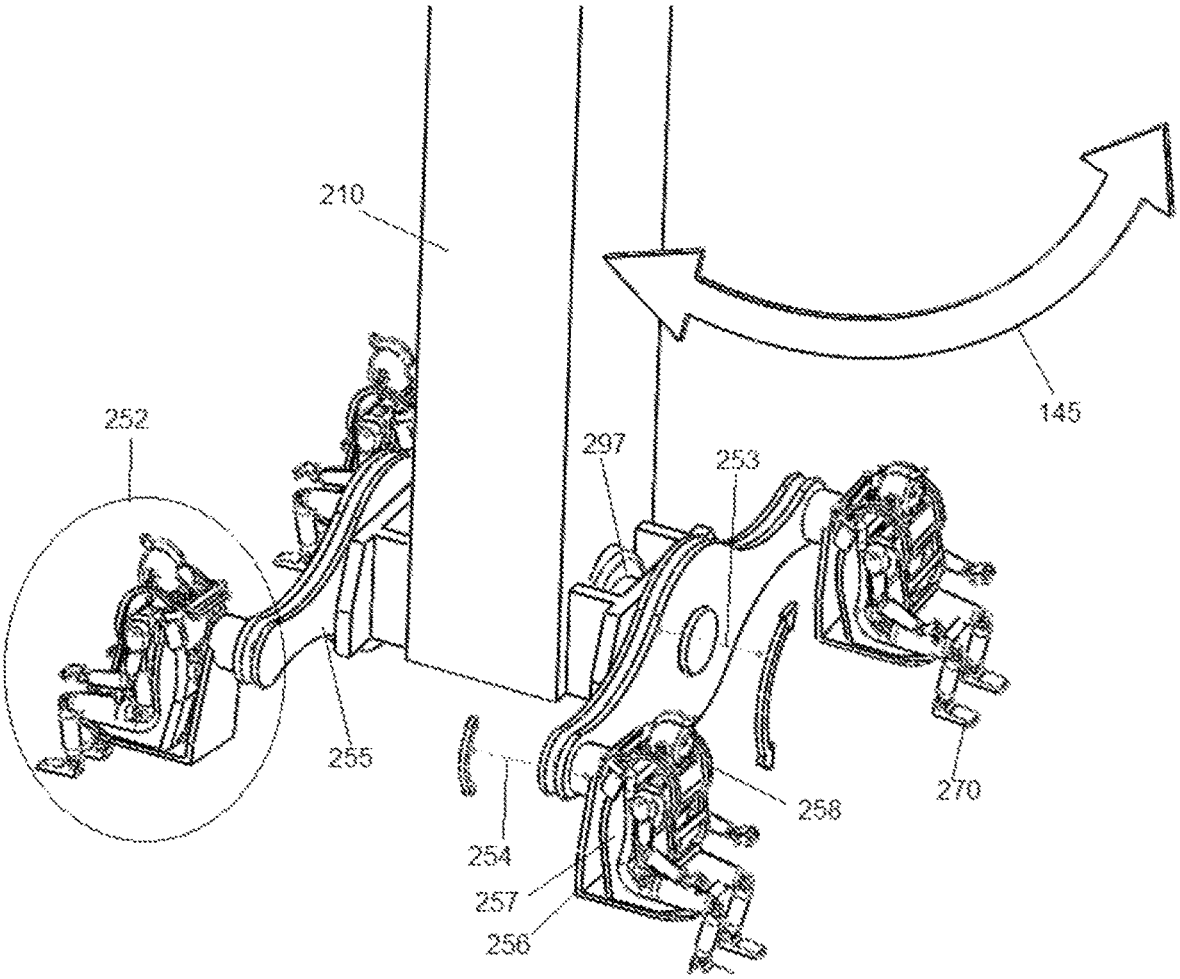
FIG. 3 is a perspective view of described amusement ride including rotary unites and shows the direction of the rotation axis in relation to swinging direction of the swing arm.
Figure 4:
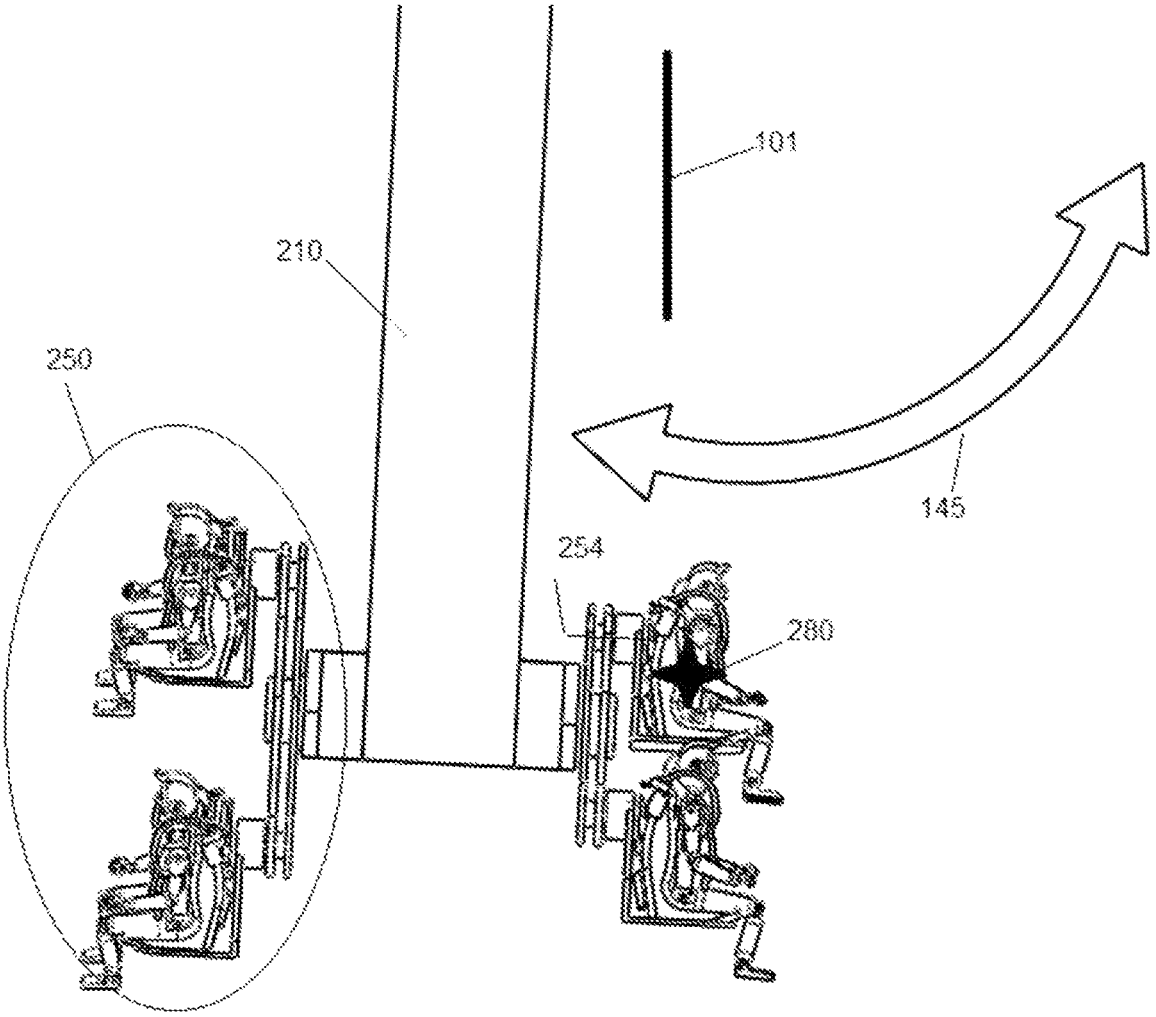
FIG. 4 is a side view of described amusement ride and shows the orientation of the swing arm and rotary unites in relation to the vertical line 101, the swing direction 145.
Figure 5A:
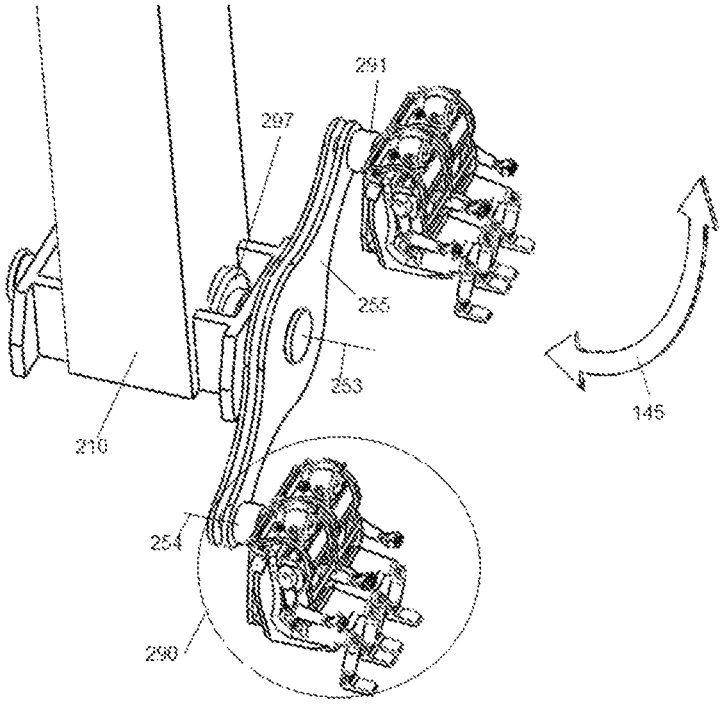
FIG. 5A is a view of described amusement ride and shows the seat assembly with two seats.
Figure 5B:
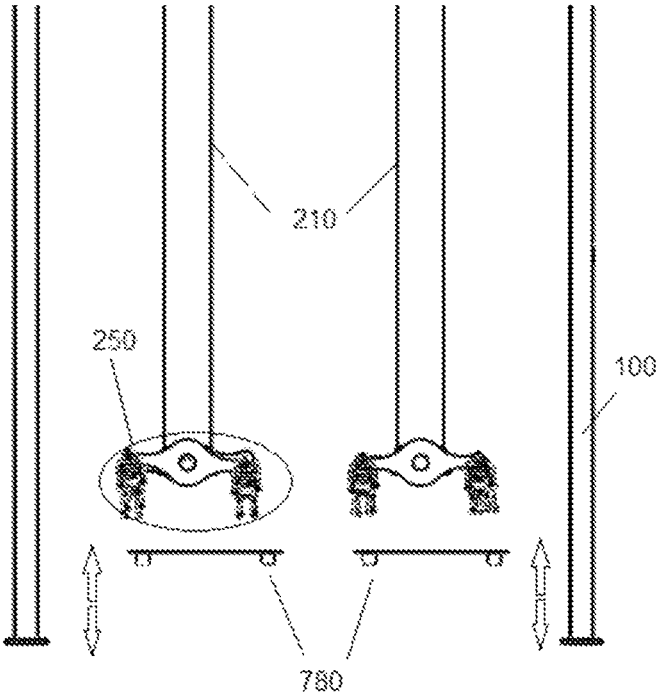
FIG. 5B is a front view of described amusement ride, and shows the orientation of the rotary unites and moving base in the loading position. The moving base 780 are designed to move and providing best accessibility for loading and unloading the riders.
Figure 6A:
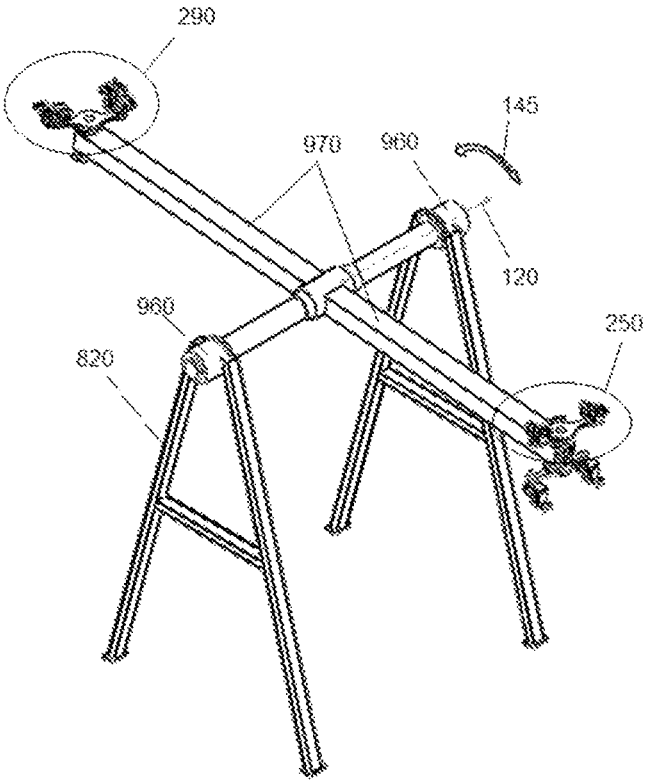
FIG. 6A is a perspective view of described amusement ride and shows the swing arm wherein the middle section of the swing arm connected to the supporting location of the frame.
Figure 6B:
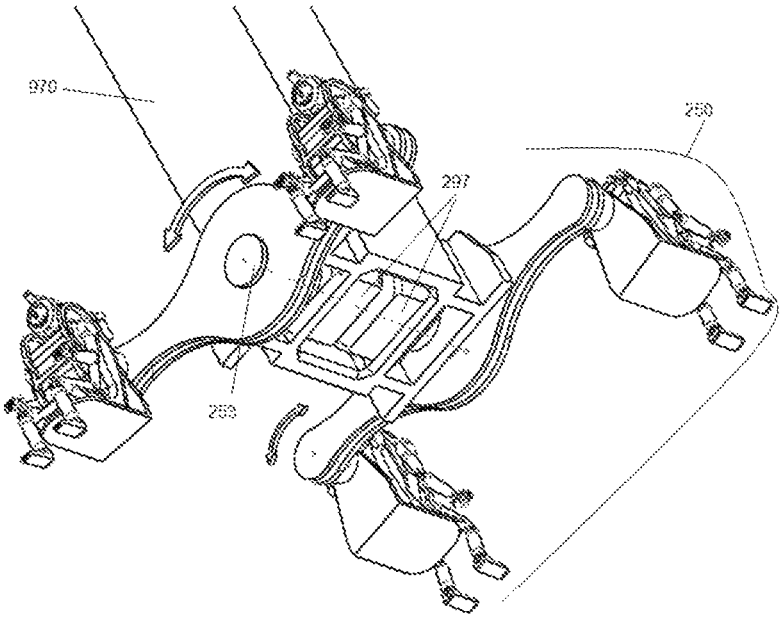
FIG. 6B is a perspective view of described amusement ride and shows the rotary unites and swing arm in the case that the middle section of the swing arm connected to the supporting location of the frame.

The frame 100 including at least one base support 10 adapted to be mounted on a supporting surface, and a supporting location 112 wherein said supporting location is distal from base support vertically;

The swing arm 210 rotatably/pivotally connected to the supporting location of said frame and rotates/swings around a swing axis 120 see FIG. 1;

The rotary unit 250 comprising the rotary arm 255, and seat assembly 252, The rotary arm 255 rotatably connected to the swing arm 210 and rotates around a rotation axis 253 wherein said rotation axis 253 is distal from swing axis 120, wherein said rotation axis 253 is approximately perpendicular to the swing axis 120. See FIGS. 1, and 3;

the seat assembly 252 comprising a chassis 256 rotatably/pivotally connected to the rotary arm 255 and rotates/swings around a pivot axis 254, wherein the pivot axis 254 is distal from the rotation axis 253, wherein pivot axis 254 is approximately parallel with the rotation axis 253;

The seat 257 mounted on the chassis for seating a passenger 270, wherein the seat assembly and the passenger together having a center mass 280 that is distal from the pivot axis 254. See FIG. 4. Additionally the chassis 291 could be designed so that more than one seat is mounted on the chassis and the pivot axis 254 passes between the passengers or passes from the middle of the row of the passengers. See FIG. 5A. Furthermore, said seat assembly 252 could be connected face forward, backward, sideward, upward or downward to the rotary arm 255 with respect to the supporting surface;

The drive means 297 mounted between said swing arm 210 and said rotary arm 255 rotating rotary arm 255 around the rotation axis 253. See FIG. 2;

The swing drive means 900 mounted between said frame 100 and said swing arm 210 swinging/rotating said swing arm 210 around the swing axis 120. See FIG. 1;

The swing drive means 900 comprising at least one actuator or motor gearbox providing required torque for rotating said swing arm 210;

The drive means 297 comprising at least one actuator or motor gearbox providing required torque for rotating rotary arm 255.

The seat 257 comprising a restraint 258 for restraining said at least one rider through motions in all three planes.

The amusement ride allows the rider 270 to rotate/swing around said pivot axis 254 due to the weight and the forces as said rotary arm 255 rotates, and said swing arm 210 swinging/rotating around said swing axis 120. Additionally, in another design the swing arm 970 from middle section rotatably connected to the support location of the frame 820 and swings/rotates around swing axis 120 and swing drive means 960 providing required torque for rotating the swing arm 970. See FIGS. 6A & 6B.

Another Aspect of Described Amusement Ride

Figure 9:
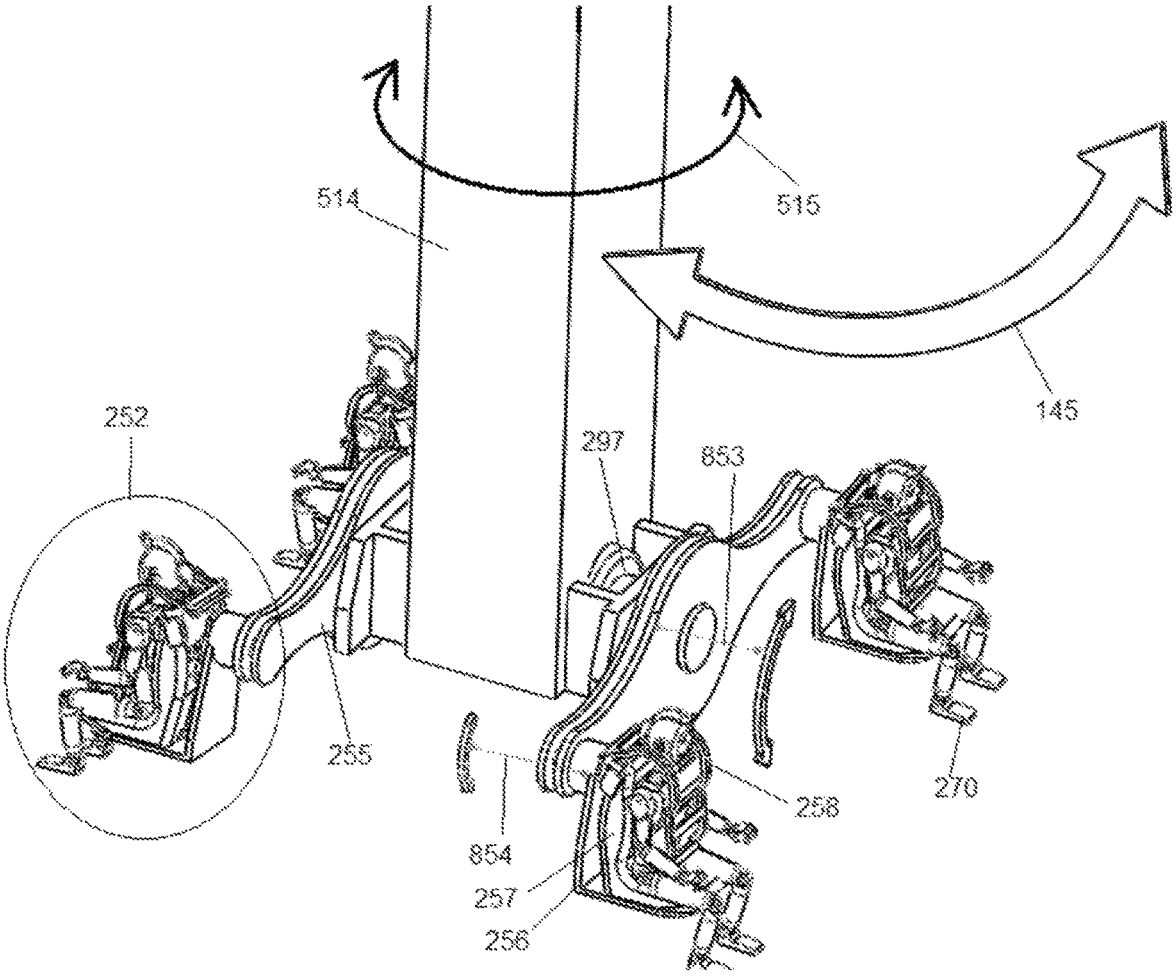
FIG. 9 is a perspective view of another embodiment of the described amusement ride and shows the details of rotary unities.

Another aspect and advantages of described invention will become apparent in the following description The amusement, comprising:

The frame 500 including at least one base support 20 adapted to be mounted on a supporting surface, and a supporting location wherein said supporting location is distal from base support vertically. See FIG. 7;

The rotary-swing arm 510 having a swing crank-arm 512 and a rotary crank-arm 514; a first end of the swing crank-arm 512 rotatably/pivotally connected to the supporting location of said frame 500 and rotates/swings around a swing axis 120, a second end of the swing crank-arm having an axle axis 520; a first end of the rotary crank-arm 514 rotatably connected to the second end of the swing crank-arm 512 rotating around the axle axis 520. See FIG. 7;

The swing drive means 950 mounted between said frame 500 and said rotary-swing arm 510 for swinging/rotating said rotary-swing arm 510 around the swing axis 120. See FIG. 7;

The axial drive means 800 mounted between said swing crank-arm 512 and said rotary crank-arm 514 for rotating said rotary crank-arm around said axle axis 520. See FIG. 8B;

The rotary arm 255 rotatably connected to a second end of the rotary crank-arm 514 and rotates around a first axis 853 wherein said first axis 853 is distal from swing axis 120, wherein said first axis 853 is approximately perpendicular to the axle axis 520;

The seat assembly 252 comprising a chassis 256 rotatably/pivotally connected to the rotary arm 255 and rotates/swings around a second axis 854, wherein the second axis 854 is distal from the first axis 853, wherein second axis 854 is approximately parallel with the first axis 853, at least one seat 257 mounted on the chassis 256 for seating a passenger 270, wherein the seat assembly and the passenger together having a center mass 280 that is distal from the second axis. See FIG. 9;

The rotary drive means 297 mounted between said rotary crank-arm 514 and said at least one rotary arm 255 rotating rotary arm around a first axis 853 See FIGS. 8 & 9.

The swing drive means 950 comprising at least one actuator or motor gearbox providing required torque for rotating said at least rotary-swing arm around the swing axis.

The seat 257 comprising a restraint 258 for restraining said at least one rider 270 through motions in all three planes.

Furthermore the described amusement ride allows said at least one rider 270 to rotate/swing around said second axis 854 substantially due to the weight and the forces as the rotary arm 255 rotates, said rotary swing arm 510 swinging/rotating around said swing axis 120, and rotary crank-arm 514 spinning axially around axle axis 520.

Another Aspect of Described Amusement Ride

Figure 10A:
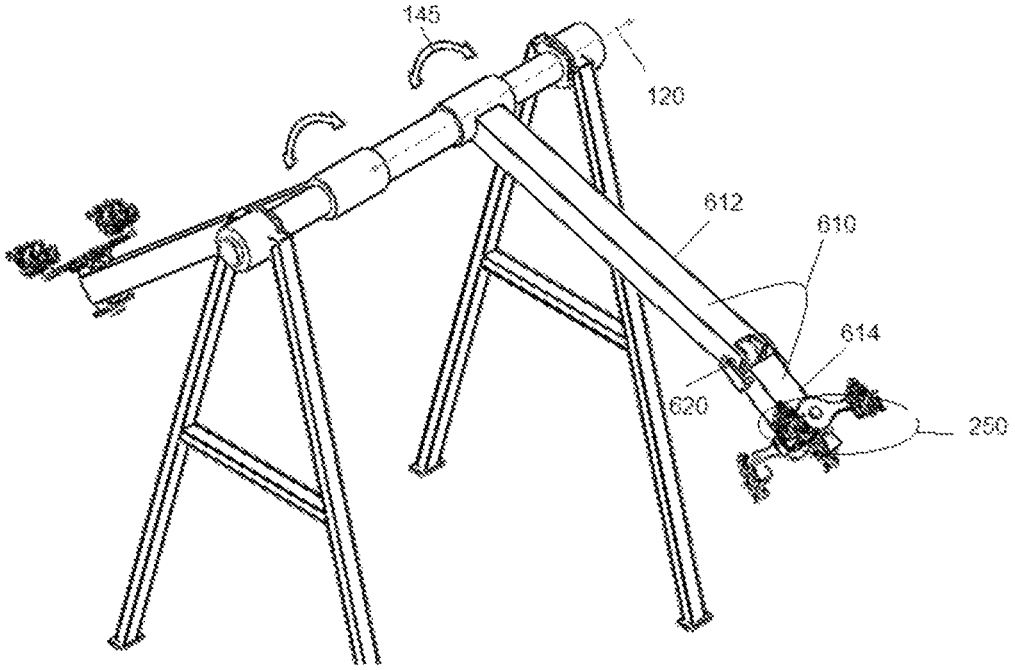
FIG. 10A is a perspective view of another embodiment of the described amusement ride and shows the rotary unities and tilting of the rotary head-arm around head axis to the down side.
Figure 10B:
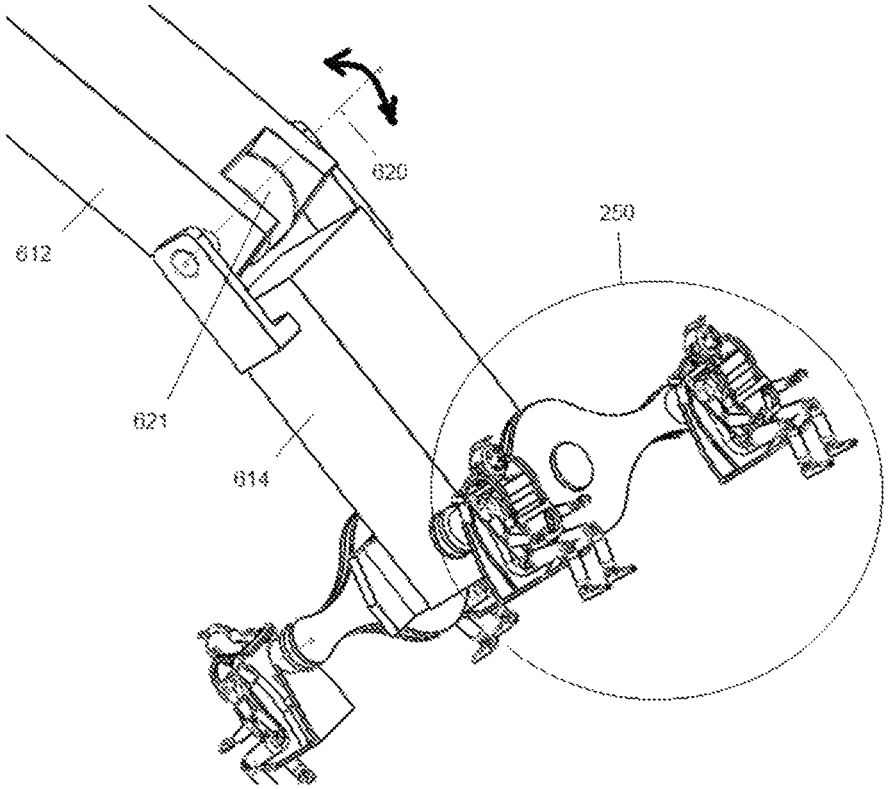
FIG. 10B is a perspective view of another embodiment of the described amusement ride and shows the details of the rotary unities and tilting the rotary head-arm around the head axis 620.

Another aspect and advantages of the invention described an amusement rides that rotary swing arm 610 comprising swing crank-arm 612 and rotary head-arm 614. See FIGS. 10A & 10B, wherein rotary head-arm 614 rotating around head axis 620. Head drive means 621 provide required torque for tilting the rotary head arm 614.

The rotary unit 250 rotatably mounted on the rotary head-arm 614. The swing crank-arm 612 rotatably connected to the support frame 500 and rotating/swinging around the swing axis 120.

Another Aspect of Described Amusement Ride

Figure 11A:
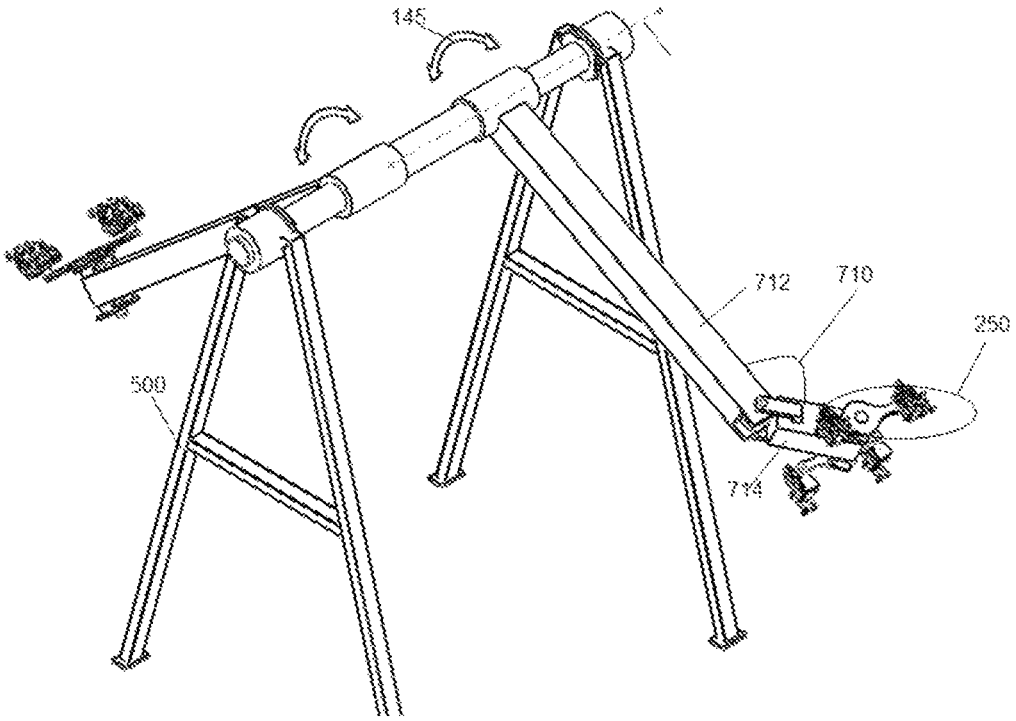
FIG. 11A is a perspective view of another embodiment of the described amusement ride and shows the rotary unities and tilting of the rotary head-arm around head axis to the left side.
Figure 11B:
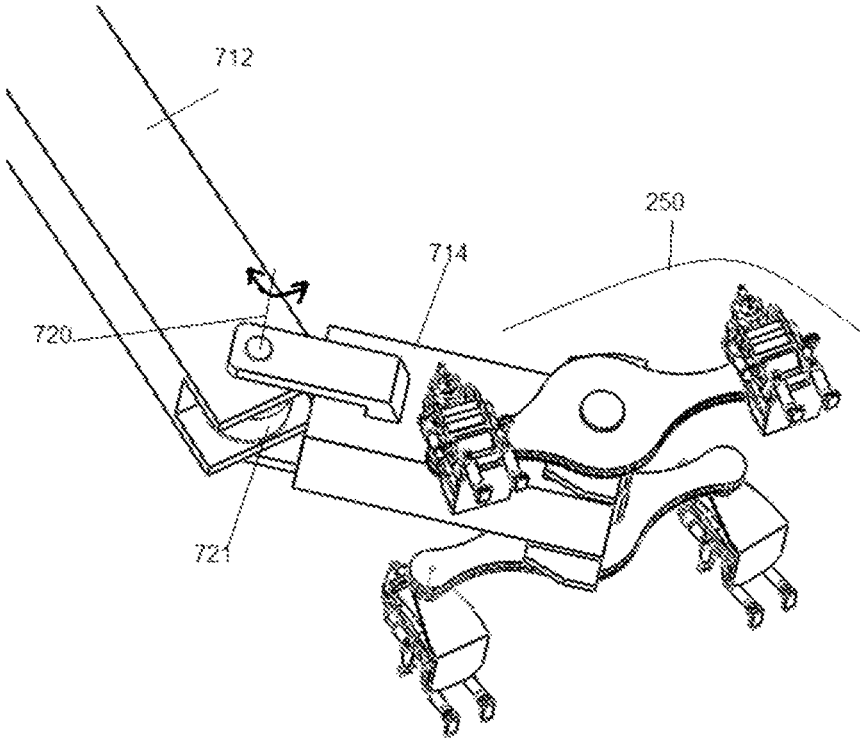
FIG. 11B is a perspective view of another embodiment of the described amusement ride and shows the details of the rotary unities and tilting the rotary head-arm around the head axis 720.

Another aspect and advantages of the invention described an amusement rides that rotary swing arm 710 comprising swing crank-arm 712 and rotary head-arm 714. See FIGS. 11A & 11B, wherein rotary head-arm 714 rotating around head axis 720. Head drive means 721 provide required torque for tilting the rotary head arm 714.

The rotary unit 250 rotatably mounted on the rotary head-arm 714.

The swing crank-arm 712 rotatably connected to the support frame 500 and rotating/swinging around the swing axis 120.

What is claimed is:

1. An amusement ride, comprising:

a frame including at least one base support adapted to be mounted on a supporting surface, and a supporting location wherein said supporting location is distal from said at least one base support vertically;

at least one swing arm rotatably or pivotally connected to the supporting location of said frame and rotates or swings around a swing axis;

at least one rotary arm rotatably connected to said at least one swing arm and rotates around a rotation axis wherein said rotation axis is distal from the swing axis;

at least one seat assembly comprising a chassis rotatably or pivotally connected to said at least one rotary arm and rotates or swings around a pivot axis, wherein the pivot axis is distal from the rotation axis, at least one seat mounted on the chassis for seating at least one rider, and at least one restraint for restraining said at least one rider;

at least one drive means mounted between said at least one swing arm and said at least one rotary arm for rotating said at least one rotary arm around the rotation axis; and, at least one swing drive means mounted on said support frame for swinging or rotating said at least one swing arm around the swing axis.

2. The amusement ride of claim 1 wherein said at least one swing drive means comprising at least one actuator or motor gearbox providing required torque for rotating or swinging said at least one swing arm.

3. The amusement ride of claim 1 wherein said at least one drive means comprising at least one actuator or motor gearbox providing required torque for rotating said at least one rotary arm.

4. The amusement ride of claim 1 allows said at least one rider to rotate or swing around said pivot axis, wherein said at least one rotary arm rotating said at least one rider around the rotation axis, wherein said at least one swing arm swinging or rotating said at least one rider around the swing axis.

5. An amusement ride, comprising:

a frame including at least one base support adapted to be mounted on a supporting surface, and a supporting location wherein said supporting location is distal from said at least one base support vertically;

at least one rotary-swing arm having a swing crank-arm and a rotary head-arm; a first end of the swing crank-arm rotatably or pivotally connected to the supporting location of said frame and rotates or swings around a swing axis; a first end of the rotary head-arm rotatably or pivotally connected to a second end of the swing crank-arm rotating or swinging around a head axis;

at least one swing drive means mounted between said frame and said at least one swing crank-arm for swinging or rotating said swing crank-arm around the swing axis;

at least one head drive means mounted between said swing crank-arm and said rotary head-arm for rotating or swinging said rotary head-arm around said head axis;

at least one rotary arm rotatably connected to a second end of the rotary head-arm and rotates around a first axis, wherein said first axis is distal from the swing axis;

at least one seat assembly comprising a chassis rotatably or pivotally connected to said at least one rotary arm and rotates or swings around a second axis, wherein the second axis is distal from the first axis, at least one seat mounted on the chassis for seating at least one rider, and a restraint for restraining said at least one rider; and, at least one rotary drive means mounted on said at least one rotary-swing arm for rotating said at least one rotary arm around the first axis.

6. The amusement ride of claim 5, wherein said at least one swing drive means comprising at least one actuator or motor gearbox providing required torque for rotating or swinging said at least one rotary-swing arm around the swing axis.

7. The amusement ride of claim 5, wherein said at least one head drive means comprising at least one actuator or motor gearbox providing required torque for rotating or swinging said rotary head-arm around the head axis.

8. The amusement ride of claim 5, wherein said at least one drive means comprising at least one actuator or motor gearbox providing required torque for rotating said at least one rotary arm around the first axis.

9. The amusement ride of claim 5 allows said at least one rider to rotate or swing around said second axis, wherein said at least one rotary arm rotating said at least one rider around the first axis, wherein the rotary head-arm rotating or swinging said at least one rider around the head axis, wherein said at least one rotary-swing arm rotating or swinging said at least one rider around the swing axis.

* * * * *